United States Patent [19]

Stegmeier

[11] Patent Number: 4,906,129

[45] Date of Patent: Mar. 6, 1990

[54] SWIMMING POOL CONTRACTION-EXPANSION JOINT

[76] Inventor: William J. Stegmeier, 3313 Ambassador Row, Arlington, Tex. 76013

[21] Appl. No.: 288,418

[22] Filed: Dec. 21, 1988

Related U.S. Application Data

[63] Continuation-in-part of Ser. No. 140,827, Jan. 5, 1988, Pat. No. 4,815,888.

[51] Int. Cl.[4] ..... E01C 11/10

[52] U.S. Cl. ..... 404/64; 404/69

[58] Field of Search ..... 404/47–49, 404/64–69, 2; 14/16.5; 52/396, 403, 573

[56] References Cited

U.S. PATENT DOCUMENTS

| | | | |
|---|---|---|---|
| 2,042,408 | 5/1936 | Lawrence | 404/69 |
| 2,100,238 | 11/1937 | Burgess | 404/49 X |
| 3,411,260 | 11/1968 | Dill | 404/48 X |
| 3,896,597 | 7/1975 | Deason | 52/396 |
| 4,346,542 | 8/1982 | Tateno | 404/48 X |
| 4,548,009 | 4/1985 | Dahowski | 52/396 |
| 4,815,888 | 3/1989 | Stegmeier | 404/4 |
| 4,841,704 | 6/1989 | Jarrell | 404/64 X |

FOREIGN PATENT DOCUMENTS

| | | | |
|---|---|---|---|
| 2503821 | 10/1982 | France | 404/48 |

*Primary Examiner*—Jerome W. Massie
*Assistant Examiner*—Matthew Smith
*Attorney, Agent, or Firm*—Daniel Rubin

[57] ABSTRACT

A polymer plastic contraction-expansion joint element for the aggregate decking areas of a swimming pool. The element when used as a contraction joint is comprised of an elongated generally hollow body adapted for burial in the aggregate just below grade level. The body is formed of a bottom wall and parallel spaced apart upright sidewalls terminating at their upper distal ends in an open pocket including longitudinal protuberances oppositely extending along the inner face of the sidewalls. Adapted to overlie the body pocket at grade level in a removable mounting relation thereto is an imperforate polymer plastic cover having elongated skirts downwardly depending from the opposite longitudinal side edges thereof. The skirts are insertable between the body protuberances in a springlike interfit enabling the cover to be removed and replaced as appropriate. When used as an contraction-expansion joint, the element includes a second generally hollow body mounted onto the underside of the first body for increasing the burial depth within the aggregate.

10 Claims, 1 Drawing Sheet

SWIMMING POOL CONTRACTION-EXPANSION JOINT

This application is a continuation-in-part of application U.S.S.N. 07/140,827 filed Jan. 5, 1988 now U.S. Pat. No. 4,815,888, issued Mar. 28, 1989.

TECHNICAL FIELD

The field of art to which the invention pertains comprises the art of contraction-expansion joints in aggregrate decking areas about a swimming pool.

BACKGROUND OF THE INVENTION

Expansion and contraction characteristics of concrete are well known and it common to utilize contraction and/or contraction-expansion joints at controlled intervals in order to avoid unsightly and even dangerous cracking within the affected areas. When a concrete slab or other aggregrate composition is to be utilized in the vicinity of a swimming pool, it becomes important to control cracking not only from an aesthetic point of view but to thereby prevent water from entering the cracks and penetrating to the soil beneath the slab. Uncontrolled cracking is not only unsightly in a swimming pool environment but any water penetration through to the underlying soil can under expansive soil conditions result in raised and uneven slabs that can even further compound the cracking.

To control such cracking, it is common to utilize either contraction and/or contraction-expansion joints that also accommodate slab expansion.

BACKGROUND OF THE PRIOR ART

Exemplifying contraction-expansion joints of the prior art are the disclosures of U.S. Pat. Nos. 3,896,597 and 4,548,009. Such joints of the disclosed type are in wide commercial use and are constructed almost entirely of polymer plastic composition. When installed, the joint becomes an integral unit with its top imperforate surface generally extending flush with the grade of the surrounding concrete. In that relation, the body of the joint remains buried in the decking while the upper top surface is continuously exposed to sunlight containing ultraviolet light (U.V). Over a period of several years, the U.V. adversely affects the exposed plastic eventually causing the exposed surface to gradually deteriorate to the point where repair becomes necessary.

Being that the upper top surface of the joint is integral with the remainder of the body, repair can involve removing entire sections of the joint and at least significant segments of the adjacent concrete for which the cost can prove disproportionately prohibitive.

Despite recognition of the foregoing, a ready solution therefore has not heretofore been available.

SUMMARY OF THE INVENTION

This invention relates to joint apparatus for accommodating contraction and/or expansion of concrete. More specifically, the invention relates to such a joint adapted for the decking areas about a swimming pool that eliminates at least the major maintenance problem presently associated with similar purpose joint elements currently available. Not only does the joint construction of the invention readily resolve the foregoing difficulties of maintenance repair but it achieves that result at a highly competitive cost of fabrication when compared to joint constructions commercially available for that purpose.

To effect the foregoing in accordance with the invention, the joint element construction hereof is constructed of elongated lengths of an all polymer plastic composition such as polyvinylchloride (PVC). For contraction, there is provided a generally hollow, vertically dependent upper body section adapted to be buried within the concrete just beneath the level of the finished grade. Longitudinal channels laterally joined at about mid-height to each of the body sides provide for an anchoring within the concrete. The bottom wall sectionally terminates in a V-shape defining a contractional crack inducing edge extending longitudinally of the body while the upper face defines a U-shaped open pocket. Provision is likewise made for expansion, by providing a second lower generally hollow body section adapted to mount directly onto the underside of the upper body.

For enclosing the upper pocket at grade level there is provided a detachable imperforate PVC cover that interfits within the pocket. Included within the body pocket on the interior face of the opposite sidewalls for receiving and retaining the cover are parallel protuberances integrally extending longitudinally thereof. The cover of polymer plastic, which is displaceably removable from the body, includes an imperforate horizontal upper surface that from its sides support downwardly and inwardly depending longitudinal skirts. The skirts are flexible each forming a springlike section of shape complementing the pocket protuberances. They are adapted when inserted within the body pocket to effect a springlike interference interfit with the protuberances of the body in a watertight relation. Being that the cover of the joint is readily detachable from the buried body, the cover can be conveniently replaced at the subsequent onset of ultraviolet deterioration without otherwise disturbing the body and/or adjacent concrete. By means of the construction hereof, the formidable problems previously associated with repair of such joints of the prior art are substantially eliminated by a readily available stock item which can be purchased and inserted whenever required.

It is therefore an important aspect of the invention to provide a novel joint for the contraction and/or expansion of concrete.

It is a further important aspect of the invention to effect the previous aspect with a joint element particularly suited for aggregate type pool deckings and affording enhanced maintenance features as compared to similar purpose joint constructions of the prior art.

It is a still further important aspect of the invention to effect the previous aspects with a joint element that is cost competitive as compared to existing joint structures therefor yet affording the virtues of readily replaceable covers to avoid the attendant difficulties and high maintenance costs associated with the prior art constructions.

The above noted features and advantages of the invention as well as other superior aspects thereof will further be appreciated by those skilled in the art upon reading the detailed description which follows in conjunction with the drawings.

DESCRIPTION OF THE PREFERRED EMBODIMENT

Figure 1:
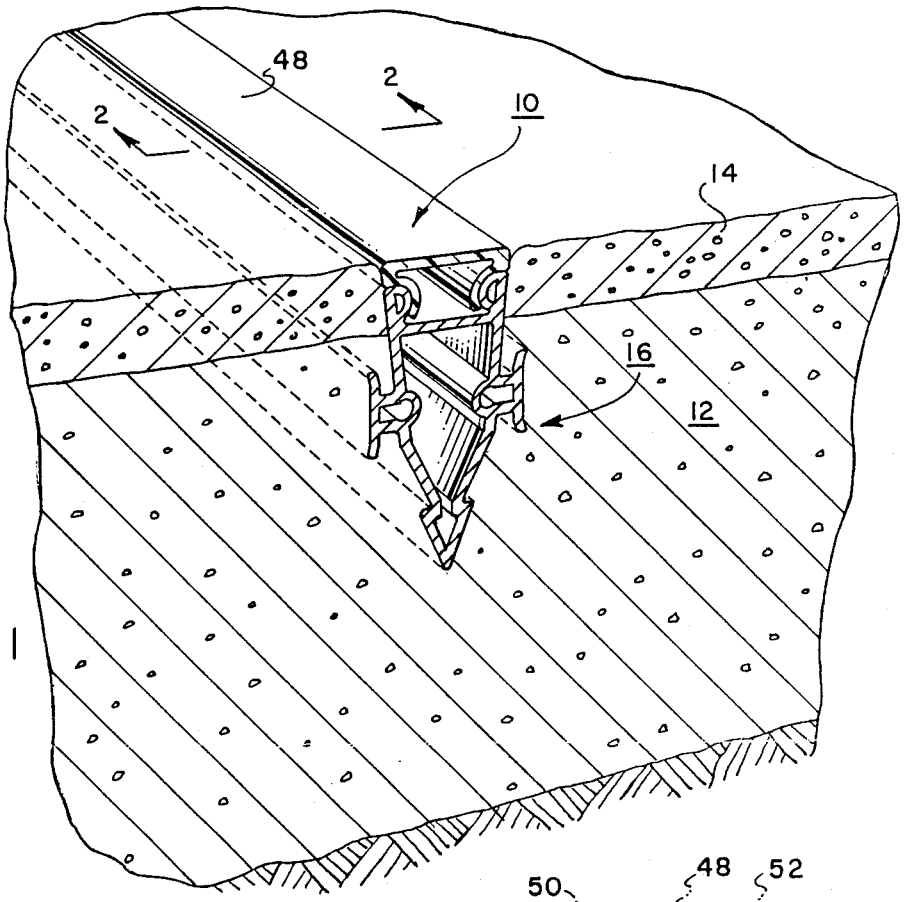
FIG. 1 is an isometric view of a contraction joint in accordance with the invention as installed in a swimming pool decking.

In the description which follows, like parts are marked throughout the specification and drawings with the same reference numerals respectively. The drawing figures are not necessarily to scale and in certain parts the drawings may have been exaggerated for purposes of clarity.

Figure 2:
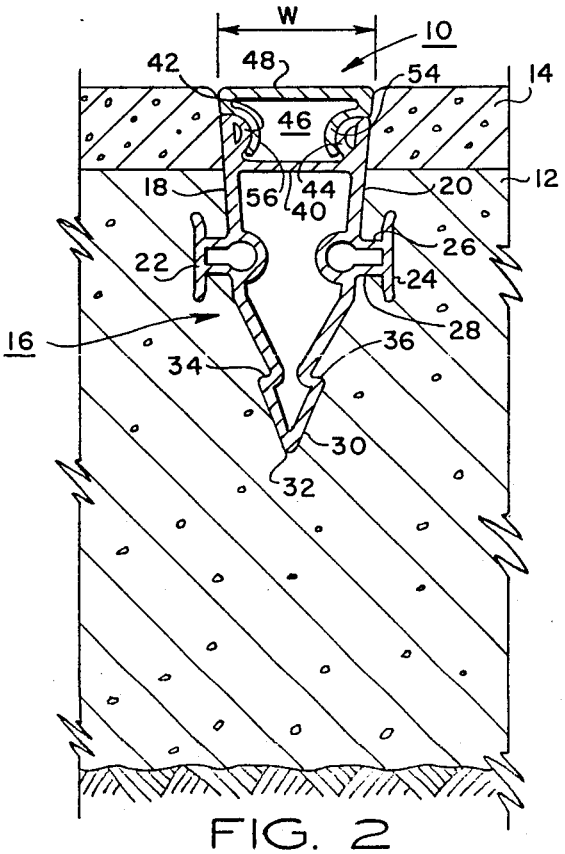
FIG. 2 a sectional elevation as seen substantially from the position 2—2 of FIG. 1.

Referring now to the drawings, the joint apparatus hereof is generally designated 10. As shown in FIGS. 1 and 2 the joint apparatus comprises a contraction element secured in an aggregate base decking 12 on which an aggregate finish decking 14 is overlayed about an inground swimming pool (not shown). For purposes hereof, the joint 10 is substantially, if not completely constructed, of a polymer plastic composition such as PVC that is suitable for concrete emplacement in the manner as will be described.

Comprising the joint 10 and adapted for direct burial in the aggregate deckings 12 and 14 is an upper generally hollow body section 16 that functions in this arrangement for the purpose of accommodating contraction. Body 16 is formed of longitudinal spaced apart sidewalls 18 and 20 laterally supporting integrally formed longitudinal anchors 22 and 24. Each of the anchors define upper and lower channels 26 and 28 in which to receive concrete 12 when poured. Below the anchors, the body 16 merges toward a V-shaped underend 30 having a contractional crack inducing edge 32 extending longitudinally thereof. Longitudinal channels 34 and 36 are defined at the upper surface of end 30 in order to receive and support a lower body section 38 where optional accommodation of expansion is likewise to be afforded as will be described.

Integrally joining the sidewalls 18 and 20 near the top portion of the body is a transverse web 40 located beneath opposite arcuate protuberances 42 and 44. The protuberances extend longitudinally along the interior of the walls and with web 40 define an upper pocket opening 46 thereat.

Figure 3:
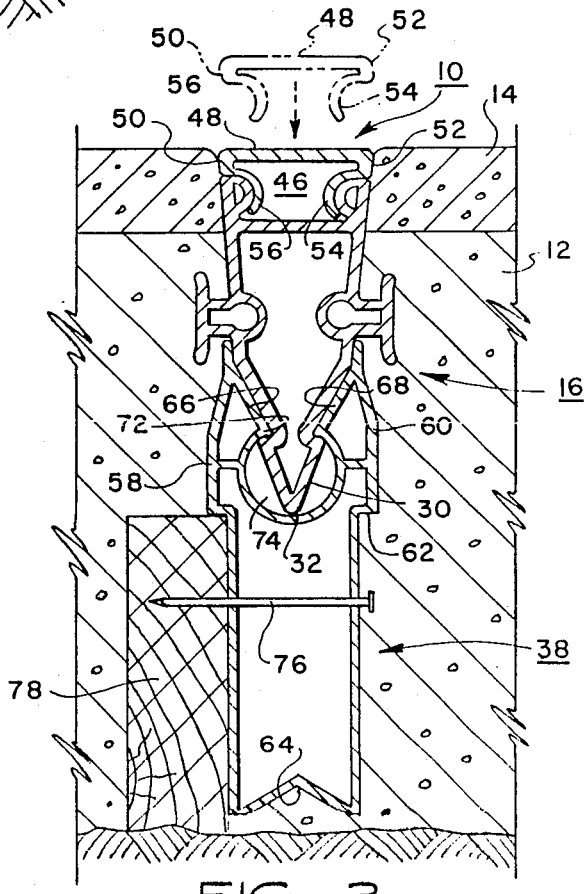
FIG. 3 is a sectional elevation of the contraction joint of FIG. 2 as adapted to likewise comprise an expansion joint.

Adapted for detachable mounting overlying the body 16 interfit within pocket 46 is an elongated imperforate cover 48 likewise formed of a PVC composition of about ⅛" thickness. For detachable mounting, the cover includes side edges 50 and 52 beneath which are an integral pair of arcuate longitudinal skirts 54 and 56 of about 1/16" thickness. The skirts are of a flexible, spring-like quality and are adapted when inserted in an interference friction fit inward of pocket 46 to effect a cooperative complementary interfit with the protuberances 42 and 44. By virtue of the spring-like resilience afforded by the skirts and the arcuate sections thereof formed generally complementary to the outer radii of the protuberances 42 and 44, the skirts are easily insertable in a snap-in friction relation thereto. With a width dimension "W" of the cover 48 just slightly less than the comparable tranverse dimension of pocket cavity 46 above body 16, the cover can be snapped into a secured watertight relation with the body or removed from the body almost at will.

Where it is desired to also afford expansion at the joint, there is provided a lower generally hollow body section 38 as illustrated in FIG. 3. Comprising the lower body section are vertically dependent parallel sidewalls 58 and 60 that include an underlying offset shoulder 62 and terminate joined at their underside in an inverted trough-shaped bottom 64. At its upper end, body 38 includes a mouth defined by merging inner walls 66 and 68 terminating at their underends in opposite longitudinal lips 72. Beneath the lips there is provided an opening 74 of circular section in which to receive lower end 30 of upper body section 16. When arranged in the manner of FIG. 3, opposite lips 72 engage the channels 34 and 36 for effecting a longitudinal and vertical interlock therewith. During installation, the lower body section is generally secured in the decking area by means of nails 76 and stakes 78 positioned under shoulder 62.

For use when only contraction control desired, upper body section 16 alone without body section 18 but with cover 48 in place is cut to an appropriate length and positioned within the deck area to be poured. The upper surface of cover 48 is positioned at finished grade level of the surrounding concrete. Thereafter the cover is retained in a removable snap-in interfit afforded by the spring skirts 54 and 56 between and against the protuberances 42 and 44. Subsequent thereto, the contraction joint functions in a conventional manner with cover 48 providing a watertight relation. Where expansion is likewise to be afforded, body section 38 is mounted below body section 16 as illustrated in FIG. 3 and staked in place.

The removable cover 48 is common to both embodiments enabling it to be removed, reinserted or replaced by a new cover as appropriate. Whenever UV deterioration of the cover 48 eventually occurs, the affected cover portions can be conveniently snapped out of the foregoing relation by withdrawing the cover upward. Following removal, the defective cover is disgarded and then replaced by a similar new cover secured to body 16 in the manner described above. For these purposes, the cover can be removed and replaced without disturbing the remaining portions of the joint or the adjacent decking aggregate in the manner of the prior art. Being simple to replace and remove, the removable cover substantially enhances the maintenance features associated with the joint by enabling the quality and appearance of the joint to be maintained at a minimum cost without the need for special equipment.

By the above description there is disclosed a novel contraction/expansion joint apparatus for concrete as specifically adapted for swimming pool deckings. The joint affords substantial improvement in eliminating many of the costly maintenance problems presently associated with similar purpose joints of the prior art and yet can be fabricated at a competitive cost of production. The feature of cover removal enables convenient replacement in a manner enabling significant cost savings in the long term maintenance of such surfaces. By virtue of the spring-like grasp of the cover skirts imposed against the body protuberances the cover will remain secured firmly in place until such time as they are forceably removed for whatever reason with a minimum of effort.

Since many changes could be made in the above construction, and many apparently widely different embodiments of this invention could be made without departing from the scope thereof, it is intended that all matter contained in the drawings and specification shall be interpreted as illustrative and not in a limiting sense.

What is claimed is:

1. A contraction joint to accommodate contraction in concrete comprising:

a first contraction element comprising a generally hollow body of polymer plastic composition adapted for burial below the concrete grade level at the site of installation; and a second contraction element comprising a replaceable generally hollow and transversely bendable water protective cover of polymer plastic composition adapted to be removably mounted in an interference fit onto said body at grade level of the site so as to cooperate with said body when mounted thereon to define a hollow pocket therebetween.

2. A contraction joint in accordance with claim 1 in which said body and said cover include cooperating means for mutually effecting said interference fit between said cover and said body.

3. A contraction joint in accordance with claim 2 in which said body is comprised of a longitudinal section having a bottom wall and parallel spaced apart generally upright sidewalls and the cooperating means on said body is comprised of first cooperating means extending longitudinally along the uppermost distal end of said sidewalls and the cooperating means of said cover is comprised of a second cooperating means adapted to mutually interfit with said first cooperating means for cooperatively effecting said interference fit between said cover and said body.

4. A contraction joint element in accordance with claim 3 in which one of said first and second cooperating means comprises a longitudinal protuberance extending along a substantially vertically oriented face of said body or cover and the other of said first and second cooperating means includes a substantially vertically oriented skirt adapted for a substantially complementary placement against said protuberance for effecting said interference fit.

5. A contraction joint element in accordance with claim 4 in which said protuberance includes an arcuate portion and said skirt includes a complementary arcuate portion for said skirt to overlie said protuberance when placed thereagainst.

6. A contraction joint element in accordance with claim 4 in which said skirt is characterized as having a springlike flexibility in the lateral direction for effecting said interference fit with said protuberance.

7. A contraction joint element in accordance with claim 6 in which said protuberance comprises a pair of opposite protuberances extending along the upper distal edges of the interior sidewalls of said body and said skirt comprises a pair of parallel skirts downwardly depending from each longitudinal side edge of said cover.

8. A contraction joint element in accordance with claims 3 or 7 in which the site for installing said joint element comprises the aggregate decking about a swimming pool and there is included anchoring means in said body to effect anchoring the body within the poured aggregate.

9. A contraction joint element in accordance with claim 8 in which said anchoring means includes longitudinal channels secured laterally integral to the exterior of said sidewalls to be embedded in the surrounding aggregate when poured.

10. A contraction joint in accordance with claim 1 in which said body comprises a first body which with said cover comprises a contraction joint and there is included a second generally hollow body adapted to be mounted to the underside of said first body to render said contraction joint a contraction-expansion joint.

* * * * *

UNITED STATES PATENT AND TRADEMARK OFFICE

CERTIFICATE OF CORRECTION

PATENT NO. : 4,906,129

DATED : March 6, 1990

INVENTOR(S) : William J. Stegmeier

It is certified that error appears in the above-identified patent and that said Letters Patent is hereby corrected as shown below:

Column 4, line 16 after "control", insert -- is --.

Column 5, line 29, delete "element".

Column 6, line 3, delete "element".

Column 6, line 8, delete "element".

Column 6, line 12, delete "element".

Column 6, line 18, delete "element".

Column 6, line 24, delete "element".

Signed and Sealed this

Twenty-second Day of January, 1991

*Attest:*

HARRY F. MANBECK, JR.

*Attesting Officer*

*Commissioner of Patents and Trademarks*